United States Patent [19]

Suzuki

[11] Patent Number: 4,708,599

[45] Date of Patent: Nov. 24, 1987

[54] ROTARY COMPRESSOR APPARATUS

[75] Inventor: Akira Suzuki, Atsugi, Japan

[73] Assignee: Hitachi, Ltd., Tokyo, Japan

[21] Appl. No.: 841,421

[22] Filed: Mar. 19, 1986

Related U.S. Application Data

[63] Continuation-in-part of Ser. No. 718,284, Apr. 1, 1985, abandoned.

[30] Foreign Application Priority Data

May 25, 1984 [JP] Japan ..... 59-104513

[51] Int. Cl.[4] ..... F04B 49/00

[52] U.S. Cl. ..... 417/295; 417/310

[58] Field of Search ..... 417/12, 290, 295, 310

[56] References Cited

U.S. PATENT DOCUMENTS

| | | | |
|---|---|---|---|
| 2,661,893 | 12/1953 | Le Valley | 417/295 |
| 3,367,562 | 2/1968 | Persson et al. | 417/290 |
| 3,448,916 | 6/1969 | Fraser | 417/295 |
| 3,602,610 | 8/1971 | Bloom | 417/12 |
| 3,860,363 | 1/1975 | Silvern | 417/12 |
| 4,035,114 | 7/1977 | Sato | 417/88 |
| 4,201,517 | 5/1980 | Ferguson | 417/12 |
| 4,406,588 | 9/1983 | Hofmann | 417/295 |
| 4,473,093 | 9/1984 | Hart | 417/295 |
| 4,529,363 | 7/1985 | Suzuki | 417/295 |

FOREIGN PATENT DOCUMENTS

| | | | |
|---|---|---|---|
| 163347 | 8/1933 | Switzerland | 417/295 |

*Primary Examiner*—William L. Freeh

*Attorney, Agent, or Firm*—Antonelli, Terry & Wands

[57] ABSTRACT

A rotary compressor unit includes a compressor, a suction valve which holds a suction line of the compressor closed before it is started and which opens the suction line of the compressor after the compressor is started by means of using the negative pressure in the suction line of the compressor, which acts on the suction valve, and a balancing valve which assists the suction valve to open the suction line smoothly and surely.

10 Claims, 6 Drawing Figures

ROTARY COMPRESSOR APPARATUS

This application is a continuation-in-part application of U.S. Ser. No. 718,284 filed Apr. 1, 1985, and now abandoned.

BACKGROUND OF THE INVENTION

1. Field of the Invention

The invention relates to a rotary compressor apparatus, and more particularly to a suction valve means incorporated in the rotary compressor apparatus including a rotary compressor of screw type or sliding vane type without feeding of the lubricating oil.

2. Description of the Prior Art

U.S. Pat. No. 4,035,114 discloses a rotary compressor apparatus in which the discharge pressure of gas compressed therein is used as an operating pressure for suction throttle valve means and in which a spring is provided for urging the suction throttle valve means to open it.

However, this type of rotary compressor apparatus would be faced with the following problems when it is started.

(1) When and immediately after the rotary compressor is started, its discharge pressure is somewhat positive or substantially null (i.e., equal to atmospheric pressure). Thus, it would be impossible to use the discharge pressure as the operating pressure for the suction throttle valve means.

(2) Since the operating pressure for the suction throttle valve means is somewhat positive or substantially null and the suction throttle valve means is always urged by the spring to be opened, the compressor would be started by a starter motor while the suction throttle valve means still remains open. The compressor is started at full load (100% load), so that an excess current is undesirably supplied to the starter motor.

In another type of rotary compressor apparatus, on the contrary, the suction throttle valve means is always urged by a spring to be closed. In this type of rotary compressor apparatus, the compressor is started at no load, however, it takes a long time to open the suction throttle valve means against the urging spring.

It has been proposed to provide a separate pressure source for the suction throttle valve means. However, this proposal would render the construction complex and increase costs because the separate pressure source requires an additional control unit therefore.

SUMMARY OF THE INVENTION

An object of this invention is to provide a rotary compressor apparatus in which a rotary compressor is capable if not only being started at no load or in substantially no load condition, but opening suction throttle valve means immediately after the compressor is started.

Another object is to provide a rotary compressor apparatus able to accomplish the above functions without a separate source of pressure for the suction throttle valve means.

Still another object is to provide a rotary compressor apparatus of simple construction capable of accomplishing the above objects.

To this end, the rotary compressor apparatus according to the invention comprises a rotary compressor, a suction valve means for regulating an amount of gas to be supplied to the compressor, a piston-cylinder unit for moving a valve element of the suction valve means to shift the suction valve means between an open position and a closed position, and means for opening the suction valve means immediately after the compressor is started.

DESCRIPTION OF THE PREFERRED EMBODIMENTS

Figure 1:
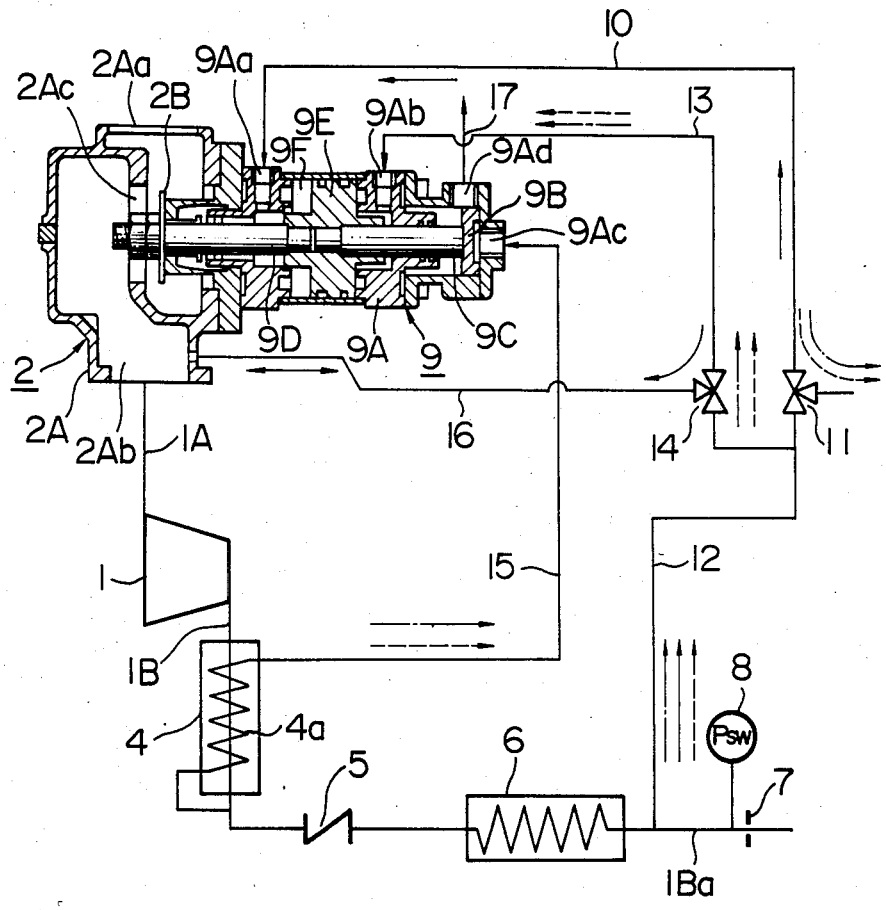
FIG. 1 is a circuit diagram of the first embodiment of the invention.

Referring to FIG. 1 showing the first embodiment, a compressor 1 comprises a suction line 1A in which a suction valve means 2 having a casing 2A and a valve element 2B is disposed. The valve casing 2A is provided with an inlet port 2A*a*, an outlet port 2A*b* and a passage 2A*c* associated with the valve element 2B to control an amount of gas passing therethrough. The compressor 1 also comprises a discharge line 1B in which a cooler 4 for exhaust gas, a check valve 5, an after-cooler 6, an orifice (pressure regulating means) 7 and a pressure switch 8 are provided.

A piston-cylinder unit 9 is mounted onto the casing 2A of the suction valve means 2 and provided with a cylinder 9A having openings 9A*a*–9A*d*. The cylinder 9A incorporates therein a gas release valve element 9B for opening and closing the gas release opening 9A*c*, a rod 9C provided at one end thereof with the valve element 9B, a rod 9D provided at one end thereof with the valve element 2B and an unloader piston 9E dividing a working chamber 9F into two chamber sections 9F*a* and 9F*b*. The other ends of the rods 9C and 9D are connected to the opposite ends of the piston 9E, respectively. The piston 9E is closely fitted to and movable within the cylinder 9A.

The opening 9A*a* of the cylinder 9A is communicated with a discharge line section 1B*a* of the discharge line 1B on the downstream side of the after-cooler 6 through a valve opening line 10, a first three-way solenoid valve 11 and an operation line 12. The opening 9A*b* of the cylinder 9A is also communicated with the discharge line section 1B*a* through a valve closing line 13 and a second three-way solenoid valve 14 and the operation line 12. The opening 9A*c* of the cylinder 9A is communicated with a heat exchanger 4*a* within the cooler 4 through a exhaust gas line 15. The second three-way solenoid valve 14 is communicated with the outlet port 2A*b* of the suction valve means 2 through a negative pressure communicating line 16. A chain line, a solid line and a broken line in the figures indicate flows of gas when the compressor is started and stopped, when a load is applied to the compressor and when a load is removed from the compressor, respectively.

The operation of the above described embodiment of the invention will be explained. When the compressor 1 is shut down, the second three-way solenoid valve 14 is so switched that the operation line 12 communicates with the valve closing line 13. The compressed air is introduced into one chamber section 9F*b* of the working chamber 9F associated with the opening 9A*b* therethrough, whereby the piston 9E is moved leftwardly in FIG. 1. The valve element 2B of the suction valve means 2 is also moved leftwardly to close the valve seat 2A*c*. At the same time, the valve element 9B is moved leftwardly together with the piston 9E to open the opening 9A*c*. Thus, the compressed air of high temperature and pressure in a line section of the discharge line 1B between the compressor 1 and the check valve 5 is cooled within the cooler 4 and then released into the atmosphere from an air releasing line 17 via the exhaust gas line 15 and the opening 9A*c*.

As described hereinabove, before the compressor 1 is started, the suction valve means 2 is always maintained in a full closed position. Accordingly, the compressor can be started at no load condition. After the compressor 1 is started, the second solenoid valve 14 is so switched by means of an unloader timer 24, as discussed with respect to FIG. 4 below, that the valve closing line 13 communicates with the line 16. Accordingly, the outlet port 2A*b* communicates with the one chamber section 9F*b* of the working chamber 9F associated with the opening 9A*b*. A negative pressure is applied to the port 2A*b* and the one chamber section.

Since the valve element 2B is smaller in diameter thereof than the piston 9E, the piston 9E receives a higher load than the valve element 2B does. Meanwhile, when the first solenoid valve 11 is so switched that the operation line 12 communicates with the valve opening line 10, a low level pressure is introduced into the other chamber section 9F*a* of the working chamber 9F associated with the opening 9A*a*. The higher load as well as the low level pressure both noted hereinabove are applied to the piston 9E to move it rightwardly in the figure, so that the valve element 2B of the suction valve means 2 is moved together with the rod 9D away from the passage 2A*c* to open the valve means 2. Therefore, the gas is introduced into the compressor 1 through the inlet port 2A*a* and the outlet port 2A*b*, and then the compressor 1 is to be operated in the full load condition, instead of the no load condition. Namely, in this embodiment, the compressor can be started in no load condition and operated in full load condition.

The compressor 1 is controlled in its displacement as follows. The pressure in the discharge line section 1B*a* is detected by the pressure switch 8. The two solenoid valves 11 and 14 are suitably switched in accordance with the value of the sensed pressure to control the valve element 2B as explained below with reference to FIG. 4.

When the pressure in the discharge line 1B*a* exceeds the predetermined (upper limit) value, the pressure switch 8 is switched to the "OFF" position. Consequently, the solenoid 14A of valve 14 is demagnetized by the signal from the control circuit 21, so that the line 12 communicates with the line 13. Simultaneously, the solenoid 11A of valve 11 is also demagnetized, so that the valve 11 communicates the line 10 to the atmosphere. Accordingly, the pressurized gas from the discharge line 1B*a* flows into the chamber 9F*b* through the line 12, the valve 14, the line 13 and the opening 9A*b*. The pressurized gas moves the piston 9E leftwards (as viewed in FIGS. 1 and 2), so that the valve element 2B is moved to the valve seat 2A*c* via rod 9D. Consequently, the suction valve means 2 is closed to change the compressor into the unload condition.

When the pressure in the discharge line 1B*a* falls below the predetermined (lower limit) value according to the increasing of air consumption, the pressure switch 8 is switched to the "ON" position. Consequently, the solenoid 14A of valve 14 is magnetized by the signal from the control circuit 21, so that the valve 14 communicates the line 13 with the line 16. Simultaneously, the solenoid 11A of valve 11 is also magnetized so as to communicate the line 12 with the line 10. Accordingly, the pressurized gas in the discharge line 1B*a* flows into the chamber 9F*a* through the line 12, the valve 11, the line 10 and the opening 9A*a*. The pressurized gas moves the piston 9E rightward (as viewed in FIGS. 1 and 2), so that the valve element 2B is moved apart from the passage 2A*c*. Consequently, the suction valve means 2 is opened so as to change the compressor into a load condition.

Figure 4:
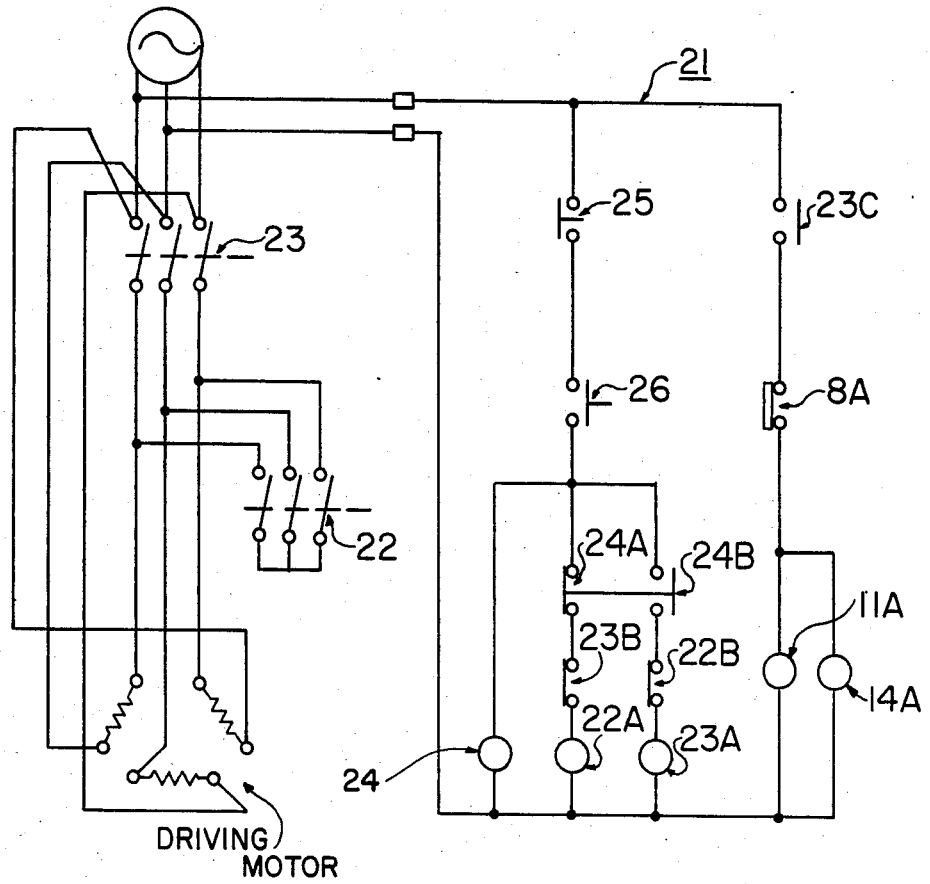
FIG. 4 is a circuit diagram of the control circuit including a starter circuit for the rotary compressor units of FIGS. 1 and 2.

FIG. 4 shows the control circuit 21 including a starter circuit. The three-phase supply is electrically connected to the motor for driving the compressor through a solenoid switch 22 for star-start, and a solenoid switch 23 for switching the star-connection to the delta-connection. In FIG. 4, the reference numeral 24 designates a timer, 22A designates a coil of the solenoid switch 22, 23A designates a coil of the solenoid switch 23, 25 designates a stop switch, 26 designates a start switch, and 24A and 24B designate contacts of the timer 24. The contact 24A is maintained in the "ON" position during a set time of the timer 24, and the contact 24B is switched to the "ON" position after lapse of the set time. The reference numeral 22B designates a contact associated with the solenoid switch 22, which is in the "OFF" position while the solenoid switch 22 is in the "ON" position, and which to the contrary, is in the "ON" position while the solenoid switch 22 is in the "OFF" position. The reference numeral 23B designates a contact associated with the solenoid switch 23, which is in the "OFF" position while the solenoid switch 23 is in the "ON" position, and which to the contrary, is in the "ON" position while the solenoid switch 23 is in the "OFF" position.

The reference numeral 23C is a contact associated with the solenoid switch 23 (or the timer 24), which is switched into the "ON" position when the solenoid switch 23 is switched into the "ON" position (or after lapse of the set time). The reference numeral 8A designates a contact of the pressure switch 8, which is in the "ON" position in a pressure lower than the predetermined value and is in the "OFF" position in a pressure higher than the predetermined value. When the start switch 26 is switched on, the solenoid switch 22 for star-start is switched to the "ON" position. After lapse of the timer set time (e.g., 15 sec.), the contacts 23B and 22B are switched into the "OFF" and "ON" positions respectively and then the solenoid switch 23 for switching the star-connection into the delta-connection is switched into "ON" position. Accordingly, the star-delta start is completed. On the other hand, the contact 23C is switched into the "ON" position when the solenoid switch 23 is switched into the "ON" position (after lapse of the timer set time), so that both of solenoids 11A and 14A of the valves 11 and 14 are switched into the "ON" positions.

Thus, the valve 14 cooperates with the timer 24 and the pressure switch 8. Namely, at start of the system, the pressure in the discharge line 1B*a* is lower and then the pressure switch 8 is in the "ON" position. However, the "0FF" signal is delivered from the timer 24 to the second valve 14 so as to communicate the line 12 with the line 13. On the other hand, the first valve 11 also cooperates with the timer 24 and the pressure switch 8. At start of the system the pressure switch 8 is in the "ON" position by the same reason as the above one, and the "OFF" signal is delivered from the timer 24 to the first valve 11 so as to communicate the line 10 to the atmosphere. After lapse of the timer set time, the signal from the timer 24 is the "OFF" one and the signal from the pressure switch 8 is also the "OFF", so that the first valve 11 is switched to the "OFF" position. Consequently, the line 13 communicates with the line 16 and the first valve 11 is switched into the "OFF" position so as to communicate the line 12 with the line 10. Accordingly, the valve element 2B is moved apart from the valve seat 2C so as to change the compressor into a load condition. The chart below illustrates these relationships with respect to the operational modes of the rotary compressor.

| | OPERATION MODE | | |
|---|---|---|---|
| | STARTING | LOAD OPERATION | UNLOAD OPERATION |
| FIRST VALVE 11 | OFF | ON | OFF |
| SECOND VALVE 14 | OFF | ON | OFF |
| TIMER | OFF (DURING SET TIME) | ON | ON |
| PRESSURE SWITCH 8 | ON | ON | OFF |

Figure 2:
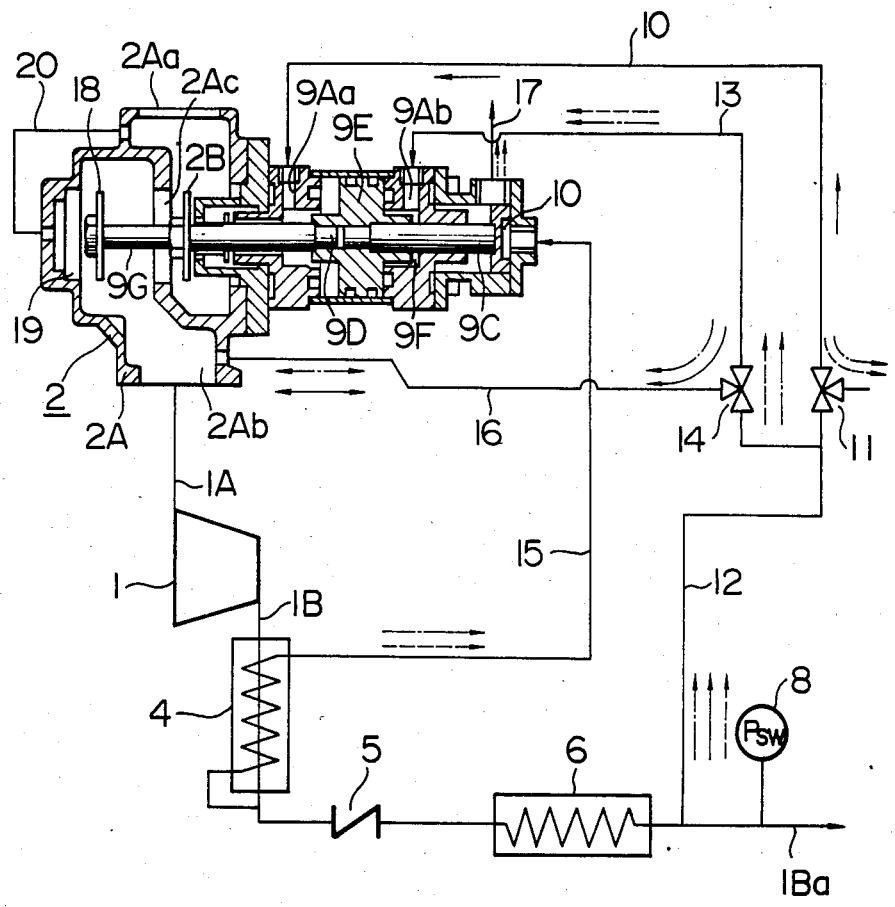
FIG. 2 is a circuit diagram of the second embodiment of the invention.

FIG. 2 shows the second embodiment of the invention. The parts similar to those shown in FIG. 1 are designated by the same reference numerals and the explanation thereof is omitted.

In the figure, a solid line, a chain line and a broken line indicate the same air flows in FIG. 1, respectively.

The numeral 18 designates a balancing valve element mounted on a free end of an extension 9G of the rod 9D. The balancing valve element 18 is equal to or somewhat smaller in diameter thereof than the valve element 2B. The numeral 19 designates a balancing recess which receives the balancing valve element 18 and the numeral 20 designates a line providing a communication between the balancing recess 19 and the inlet port 2A*a*.

The suction valve means 2 is disposed in the suction line 1A. The cooler 4, check valve 5 and the aftercooler 6 are sequentially disposed in the discharge line 1B. The orifice 7 shown in FIG. 1 is not provided in the discharge line section 1B*a* in this embodiment. The lines 10, 12, 13, 15 and 16, and three-way solenoid valves 11 and 14 are similar in construction to those shown in FIG. 1.

The function of the balancing valve element 18 will be described with referring to FIGS. 2, 3(*a*) and 3(*b*).

Before the compressor 1 is started, the valve element 2B is retained in the passage 2A*c*. Accordingly, when the compressor is started, the suction valve means 2 is in a full closed position. Thus, a negative pressure acts on an end surface of the valve element 2B and a load Pv is applied thereto as indicated in FIG. 3(*a*).

Figure 3A:
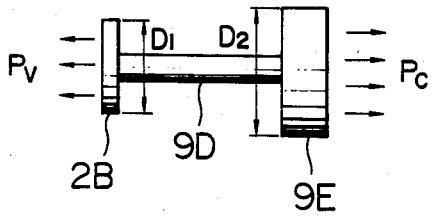
FIGS. 3(*a*) and 3(*b*) are partially fragmentary sectional views showing the operations of the valve elements in the first and second embodiments.
Figure 3B:
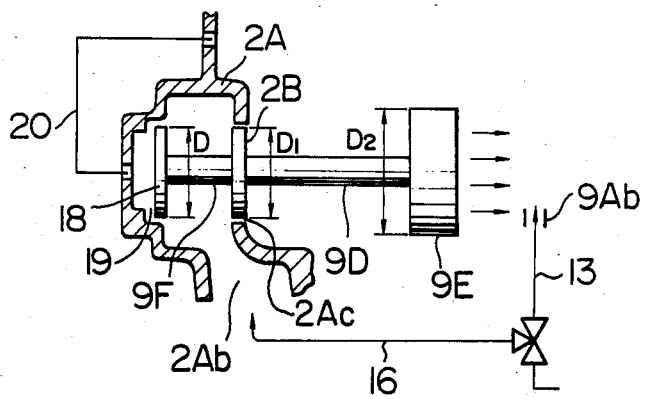

In the first embodiment, as shown in FIG. 3(*a*), a force corresponding to a following load difference P between the loads $P_c$ and $P_v$ applied to the piston 9E and the valve element 2B respectively is applied to the valve element 2B to open the suction valve means 2 when a connection state of a starter circuit 21 shown in FIG. 4 is converted from a Y-connection (Star-connection) to Δ-connection (Delta-connection) so that the outlet port 2A*b* communicates with the opening 9A*b* through the lines 16 and 13.

$$P=P_c-P_v=(\pi/4)\times P_1\times(D_2^2-D_1^2)$$

where

P: force for opening the suction valve means;

$P_1$: negative pressure in the outlet port 2A*b*;

$D_1$: diameter of the valve element 2B;

$D_2$: diameter of the piston 9E; and $D_2>D_1$.

The force acting on the valve element in the second embodiment of the invention will be explained with reference to FIG. 3(*b*).

Assuming that the diameter of the valve element 2B is equal to the diameter of the balancing valve element 18, the negative pressure applied to the valve element 2B is cancelled by the pressure applied to the balancing valve element 18.

Thus, the force P acting on the valve element 2B to open the suction valve means 2 increases in intensity as follows.

$$P=(\pi/4)\times P_1\times D_2^2$$

where

P: force for opening the suction valve means;

$P_1$: negative pressure in the outlet port 2A*b*; and $D_2$: diameter of the piston 9E.

The increasement in the force acting on the valve element 2B makes the valve body 2B readily move rightwardly without the orifice 7 shown in FIG. 1, so that the suction valve means 2 is opened and the compressor 1 is switched from in the unload condition to in the load condition.

The operation for starting the compressor in the unload condition and then switching from the unload condition to the load condition will be explained as follows.

When the compressor 1 is started, the valve element 2B of the suction valve means 2 is retained in the passage 2A*c* to close the suction valve means 2. Thus, the compressor 1 is started in the unload condition. At this time, the balancing valve 18 is inserted into the balancing recess 19. Since there is a small radial gap between the valve element 2B and the passage 2A*c*, a small amount of air flowing through the gap into the compressor 1 is compressed therein and forwarded to the discharge line 1B.

In such unload starting, the pressure applied to the end surface of the valve element 2B facing the outlet port 2A*b* is perfectly balanced to the pressure applied to the end surface of the balancing valve 18 facing the outlet port 2A*b*.

The three-way solenoid valves 11 and 14 are so switched by means of the unload timer 24 shown in FIG. 4 in order to change the unload condition into the load condition, that the air flows in the lines 12 and 10 to the opening 9A*a* as indicated by the solid line as shown in FIGS. 1 and 2. Accordingly, the pressure at a low level, which is about 0.1 $kg/cm^2$ (gauge) is applied to the end surface of the piston 9E associated with the opening 9A*a*.

At the same time, the outlet port 2A*b* is communicated with the opening 9A*b* by such switching operation of the solenoid valve 14 and the negative pressure is applied to the opening 9A*b*. Furthermore, the pressure applied to the valve element 2B is balanced to the pressure applied to the balancing valve element 18, as noted hereinabove. Therefore, the negative pressure applied to the end surface of the piston 9E associated with the opening 9A*b* acts as a load for smoothly moving the valve element 2B apart from the valve seat 2A*c*, to thereby bring the suction valve means 2 to an open position.

Accordingly, the compressor 1 is operated in the load condition (full load condition) instead of the unload condition. The compressor 1 is controlled in its displacement in the manner described above with reference to FIG. 4 wherein the pressure in the discharge line section 1B*a* is detected by the pressure switch 8 and the two three-way solenoid valves 11 and 14 are suitably switched in accordance with the value of the sensed pressure to control the valve element 2B.

Figure 5:
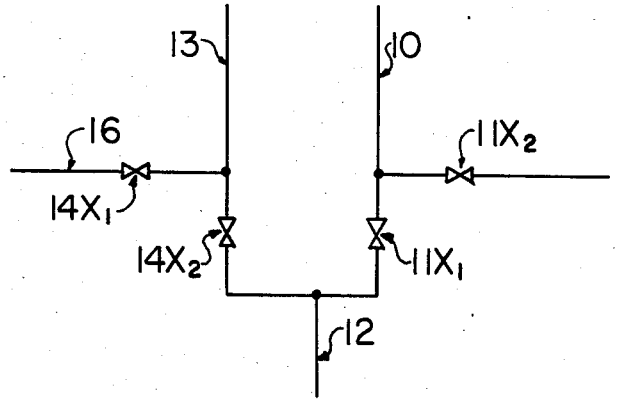
FIG. 5 is a circuit diagram of a portion of another form of the invention wherein a plurality of on-off (one-way) valves are employed rather three-way valves as in the embodiments of FIGS. 1 and 2.

According to another form of the invention illustrated in pertinent part in FIG. 5, the three-way solenoid valves 11 and 14 can be replaced with a combination of on-off (one-way) valves $11X_1$, $11X_2$, $14X_1$ and $14X_2$ for effecting the same operation of the rotary compressor as described above. The positions of the valves in the several operation modes of the compressor are illustrated in the chart below.

| | VALVE | | | |
|---|---|---|---|---|
| OPERATION MODE | 14 X1 | 14 X2 | 11 X1 | 11 X2 |
| START & UNLOAD OPERATION | CLOSED | OPENED | CLOSED | OPENED |
| LOAD OPERATION | OPENED | CLOSED | OPENED | CLOSED |

The invention may not be limited to a rotary compressor, such as a single stage oil-free screw compressor. The invention may be applicable to any other compressor.

What is claimed is:

1. A rotary compressor unit comprising:

a rotary compressor;

suction valve means for adjusting an amount of gas to be introduced into said compressor;

a piston-cylinder means for operating said suction valve means; and and actuating mechanism for actuating said piston-cylinder means, wherein said suction valve means comprises:

a casing provided therein with a gas passage, one end thereof communicating with a suction side of said compressor;

a valve element disposed movably in said gas passage to cooperate with a portion of said casing to adjust the amount of gas passing through said gas passage; and a rod provided on one end thereof with said valve element, wherein said piston-cylinder means comprises:

a cylinder; and a piston movably incorporated within said cylinder so as to divide a cylinder chamber into two working chamber sections, to which said rod is connected, wherein said actuating mechanism comprises:

an operation passage provided therein with a first valve, said operation passage connecting a discharge line of said compressor to one of said working chamber sections;

a negative pressure passage provided therein with a second valve, said negative pressure passage connecting a portion of said gas passage downstream side of said valve element of said suction valve means to the other working chamber section through two ports of said second valve; and means for controlling said second valve to open said negative pressure passage after the compressor is started; and wherein both said first and second valves are three-way solenoid valves, and a third port of said second valve is connected to said discharge line of said compressor.

2. A rotary compressor unit as claimed in claim 1, wherein a cooler, a check valve and an after cooler are sequentially incorporated within said discharge line of said compressor.

3. A rotary compressor unit as claimed in claim 1, wherein said piston is greater in diameter than said valve element of said suction valve means.

4. A rotary compressor unit comprising:

a rotary compressor;

suction valve means for adjusting an amount of gas to be introduced into said compressor;

a piston-cylinder means for operating said suction valve means; and an actuating mechanism for actuating said piston-cylinder means, wherein said suction valve means comprises:

a casing provided therein with a gas passage, one end thereof communicating with a suction side of said compressor;

a valve element disposed movably in said gas passage to cooperate with a portion of said casing to adjust the amount of gas passing through said gas passage; and a rod provided on one end thereof with said valve element, wherein said piston-cylinder means comprises:

a cylinder; and a piston movably incorporated within said cylinder so as to divide a cylinder chamber into two working chamber sections, to which said rod is connected, wherein said actuating mechanism comprises:

an operation passage provided therein with a first valve, said operation passage connecting a discharge line of said compressor to one of said working chamber sections;

a negative pressure passage provided therein with a second valve, said negative pressure passage connecting a portion of said gas passage downstream side of said valve element of said suction valve means to the other working chamber section through two ports of said second valve; and means for controlling said second valve to open said negative pressure passage after the compressor is started; and wherein a cooler, a check valve and an after cooler are sequentially incorporated within said discharge line of said compressor and wherein said unit further comprises a gas releasing valve having a gas inlet port connected to said cooler, said gas releasing valve being opened and closed by the movement of said piston.

5. A rotary compressor unit comprising:

a rotary compressor;

suction valve means for adjusting an amount of gas to be introduced into said compressor;

a piston-cylinder means for operating said suction valve means; and an actuating mechanism for actuating said piston-cylinder means, wherein said suction valve means comprises:

a casing provided therein with a gas passage, one end thereof communicating with a suction side of said compressor;

a first valve element disposed movably in said gas passage to cooperate with a portion of said casing to adjust the amount of gas passing through said gas passage; and a rod provided one end thereof with said valve element, a second, balancing valve element provided on an extension of said rod, said second, balancing valve element cooperating with a portion of said casing to define a balancing chamber when said first valve element is located in a position in which the flow rate of the gas flowing through said passage gas is minimized; and a passage for connecting said balancing chamber to a portion of said gas passage upstream side of said valve element, wherein said piston-cylinder means comprises:

a cylinder; and a piston movably incorporated within said cylinder so as to divide a cylinder chamber into two working chamber sections, to which said rod is connected, and wherein said actuating mechanism comprises:

an operation passage provided therein with a first valve, said operation passage connecting a discharge line of said compressor to one of said working chamber sections;

a negative pressure passage provided therein with a second valve, said negative pressure passage connecting a portion of said gas passage downstream side of said valve element of said suction valve means to the other working chamber section through two ports of said second valve; and means for controlling said second valve to open said negative pressure passage after the compressor is started.

6. A rotary compressor unit as claimed in claim 5, wherein said piston is greater in diameter than said valve element of said suction valve means.

7. A rotary compressor unit as claimed in claim 6, wherein both said first and second valves are three-way solenoid valves, and a third port of said second valve is connecting to said discharge line of said compressor.

8. A rotary compressor unit as claimed in claim 6, wherein said second, balancing valve element is equal to or smaller in diameter than said first valve element.

9. A rotary compressor unit as claimed in claim 6, wherein a cooler, a check valve and an after cooler are sequentially incorporated within said discharge line of said compressor.

10. A rotary compressor unit as claimed in claim 9, wherein said unit further comprises a gas releasing valve having a gas inlet port connected to said cooler, said gas releasing valve being opened and closed by the movement of said piston.

* * * * *